United States Patent [19]

Hunt et al.

[11] Patent Number: 4,832,857

[45] Date of Patent: May 23, 1989

[54] PROCESS FOR THE PREPARATION OF OVERBASED MOLYBDENUM ALKALINE EARTH METAL AND ALKALI METAL DISPERSIONS

[75] Inventors: Mack W. Hunt, Naperville; John H. Udelhofen, Wheaton, both of Ill.

[73] Assignee: Amoco Corporation, Chicago, Ill.

[21] Appl. No.: 233,454

[22] Filed: Aug. 18, 1988

[51] Int. Cl.[4] ..... C10M 135/10; C10M 155/00

[52] U.S. Cl. ..... 252/33; 252/40.7; 252/389.61; 252/400.54; 252/400.61; 252/389.54

[58] Field of Search ..... 252/33, 40.7, 389.61, 252/389.54, 400.54, 400.61

[56] References Cited

U.S. PATENT DOCUMENTS

| | | | |
|---|---|---|---|
| 3,496,105 | 2/1970 | Le Suer | 252/40.7 |
| 3,541,014 | 11/1970 | Le Suer | 252/40.7 |
| 4,293,431 | 10/1981 | Demoures et al. | 252/40.7 |
| 4,466,901 | 8/1984 | Hunt et al. | 252/42.7 |
| 4,601,837 | 7/1986 | Valcho et al. | 252/40.7 |

*Primary Examiner*—Jacqueline V. Howard

*Attorney, Agent, or Firm*—Gunar J. Blumberg; William M. Magidson; Ralph C. Medhurst

[57] ABSTRACT

A process for incorporating molybdenum into overbased alkaline earth metal and alkali metal sulfonates, phenates and salicylates. The incorporation is a post addition of molybdenum into a previously prepared overbased composition. The resulting composition containing molybdenum is gel-free, haze-free, precipitate-free, has a reproducible Total Base Number (TBN) and is commercially acceptable for use in lubricating oil compositions.

15 Claims, No Drawings

PROCESS FOR THE PREPARATION OF OVERBASED MOLYBDENUM ALKALINE EARTH METAL AND ALKALI METAL DISPERSIONS

FIELD OF THE INVENTION

The field of this invention relates to a method for preparing overbased molybdenum alkaline earth metal and alkali metal sulfonates, phenates and salicylates. More particularly, this invention relates to a process for producing overbased molybdenum alkaline earth metal sulfonates, phenates and salicylates of calcium, barium, magnesium, strontium and overbased molybdenum alkali metal sulfonates, phenates and salicylates whereby a highly effective friction-reducing, anti-oxidant and anti-rust composition is produced. The products of the process of this invention are highly overbased molybdenum alkaline earth and alkali metal sulfonates, phenates, and salicylates having a TBN (total base number) greater than about 10 (metal ratio greater than about 1.1 to 30), which products provide a combination of highly valuable properties to lubricating oils including friction modification, anti-oxidation properties and anti-rust properties.

BACKGROUND OF THE INVENTION

Molybdenum compounds are well-known for improving the properties of lubrication oils for internal combustion engines. Lubricating oils containing soluble molybdenum are known for reducing friction between moving parts in internal combustion engines, thereby improving fuel economy and increasing engine life through reduced wear.

A number of methods for preparing molybdenum-containing alkaline earth metal sulfonates have been disclosed in the art.

U.S. Pat. No. 3,496,105 (LeSuer) teaches a process for preparing molybdenum-containing alkaline earth metal sulfonates wherein an overbased carbonate alkaline earth metal sulfonate is contacted with an inorganic composition including ammonium and alkaline earth metal salts of a molybdenum-containing anion such as $MoO_4$ and $Mo_7O_{24}$. This process is characterized by the presence of a special peptizing agent required for the molybdenum-containing compound. These products, which are prepared directly from overbased carbonate materials, also suffer the disadvantage that the molybdenum incorporated in the composition can form a solid precipitate or a hazy precipitate, rendering the molybdenum-containing sulfonate material useless for lubricating oils. While haze in the lubricating oil composition does not always reduce the lubricant properties, solid precipitate can cause plugging of channels in engines and mechanical damage.

In U.S. Pat. No. 4,601,837, Valcho discloses a process for preparing overbased molybdenum alkaline earth metal sulfonate dispersions wherein a mixture is prepared from a sulfonic acid partially neutralized with ammonia, an alkaline earth metal compound, an alkanol of from one to seven carbon atoms and water. This mixture is hydrated by application of heat to produce an alkaline earth metal compound to which is added a molybdenum-containing compound and then an acidic material to form a molybdenum alkaline earth metal overbased sulfonate. Such a method of adding a molybdenum-containing compound before the addition of an acidic material has been termed a "mid-method of addition" of adding a molybdenum-containing compound to the hydrated alkaline earth metal compound. The "mid-method", as described above, suffers from the problem that the molybdenum-containing compound must be added to the hydrated alkaline earth metal compound before addition of the acidic material, thus requiring addition of the molybdenum compound during the process of preparing the molybdenum-alkaline earth metal sulfonate.

Accordingly, a need exists to provide a process for preparation of molybdenum-alkaline earth metal or alkali metal sulfonates that does not require the use of peptizing agents, that does not require the use of succinic anhydride to reduce haze, and which can be applied equally to sulfonates or phenates or salicylates, which sulfonates are not hazy, do not contain solid precipitate that can cause plugging of channels in engines and mechanical damage, and which provide anti-wear, anti-rust and anti-oxidation properties to lubricating oils and can be prepared from "off-the-shelf" alkaline earth metal or alkali metal sulfonates, phenates or salicylates.

There has now been found and developed an improved and flexible process, a so-called "post method," for producing highly basic molybdenum-alkaline earth metal and alkali metal overbased sulfonates, phenates and salicylates by an economical, efficient productive process resulting in substantial incorporation of the molybdenum into the sulfonate, phenate or salicylate which, when added to a lubricating oil, provides substantial anti-rust, anti-oxidation, and anti-wear properties to the oil and reduces the coefficient of friction of the oil. Such a method of adding a molybdenum-containing compound to an already-prepared sulfonate, phenate or salicylate compound or dispersion is termed a "post method" of addition.

The sulfonates, phenates or salicylates can be overbased calcium, barium, sodium, magnesium, strontium, potassium, or rubidium compounds. The phenates and salicylates can be sulfurized alkyl compounds. The phenates can be calcium or magnesium Mannich phenates.

The general object of this invention is to improve the properties of lubricating oils with an oil-soluble molybdenum compound wherein the molybdenum compound is incorporated into the lubricating oil in a convenient, economical method. The incorporation of molybdenum into alkaline earth of alkali metal sulfonates, phenates or salicylates is often accomplished in a convenient method if the molybdenum is in the form of a soluble compound in an aqueous solution as in U.S. Pat. No. 3,541,014 which teaches an aqueous solution of molybdate or paramolybdate. Other methods of incorporating molybdenum can require the presence of water. For example, U.S. Pat. No. 4,474,673 teaches addition of water to the reaction product of molybdenum halide and sulfurized organic compound to remove excess halide. U.S. Pat. No. 4,478,729 indicates the reaction product of a molybdenum halide with a sulfonic acid compound is preferably hydrolyzed with water. However, addition of water in preparation of overbased calcium sulfonates can result in a viscous opaque product which is unsuitable for use in a lubricating oil composition (Paper No. 10, International Corrosion Forum, Corrosion/75, National Assn. of Corrosion Engineers, Apr. 14–18, 1975, Toronto, Canada).

The present invention provides a convenient, economical method for incorporating molybdenum into an overbased alkaline earth or alkali metal sulfonate wherein the resulting product is clear, haze-free, precipitate-free and is suitable for use in a lubricating oil compositions despite the use of water as a solubilizing agent.

SUMMARY OF THE INVENTION

The present invention is a process for the manufacture of an overbased molybdenum alkaline-earth or alkali metal sulfonate, phenate and salicylate. The process comprises the addition of an aqueous solution of a molybdenum compound and a solvent to an overbased alkaline-earth or alkali metal compound wherein the amount of water is controlled within narrow limits to minimize contact with the overbased material and the water is removed from the molybdenum overbased alkaline earth of alkali metal compound mixture by "flashing off" the contained water by addition of a non-polar material at an elevated temperature over a limited time period.

The overbased molybdenum-alkaline earth metal sulfonate, phenate or salicylate produced by this process is clear, haze-free, precipitate-free, is a suitable lubricating oil additive and provides substantial anti-rust, anti-oxidation, and anti-wear properties to the oil to which it is added.

DETAILED DESCRIPTION OF THE INVENTION

The general object of this invention is to improve the properties of lubricating oils with oil-soluble molybdenum compounds wherein the molybdenum compounds are incorporated into a well-known class of basic metal-containing compounds which have been employed as detergent-dispersants and rust inhibitors in lubricating oil compositions. The addition of molybdenum provides friction-reducing and anti-wear properties to the lubricating oil composition.

Lubricating oil compositions that are suitable for use in diesel and other internal combustion engines are heavy-duty, detergent-type lubricating oil compositions and must have appropriate lubricity and stability. In addition, if a high degree of engine cleanliness is to be maintained, they must disperse insolubles that are formed by fuel combustion and/or oil oxidation and must neutralize both the acidic combustion products and acidic lacquer precursors, thus providing rust inhibition.

Lubricating oil compositions used in marine diesel engines must have a high degree of reserve basicity, since marine engine fuels have a high sulfur content. Such high sulfur content results in a large amount of acidic combustion products. While it is possible to alleviate this problem through the use of low sulfur fuels, the economics of the situation make it desirable to use a high sulfur level in conjunction with a lubricating composition capable of neutralizing the acidic combustion products.

The term "overbasing" refers to increasing the basicity of a detergent additive agent. The attainment of an oil-soluble carbonate, or other salt, of an alkaline earth metal or alkali metal in the form of extremely small particles in a finely dispersed form is a highly desirable object of overbasing.

It has now been found that molybdenum can be incorporated satisfactorily into an "off-the-shelf" overbased alkaline earth or alkali metal sulfonate or phenate or salicylate and that the resulting molybdenum alkaline earth metal or alkali metal sulfonate or phenate or salicylate can provide friction-reducing properties to an overbased alkaline earth or alkali metal detergent-dispersant lubricating oil additive in a lubricating oil composition wherein the resultant additive is clear, haze-free, precipitate-free and the lubricating oil composition has similar desirable characteristics.

For the purpose of the present invention, the amount of overbasing produced is reported as the Total Base Number (TBN), which is the number of milligrams of potassium hydroxide equivalent to the amount of acid required to neutralized the alkaline constituents present in 1 gram of the molybdenum-alkaline earth metal sulfonate. A standard procedure for measuring Total Base Number is ASTM D-2896. The metal ratio is the ratio of mole equivalents of metal in the composition to mole equivalents of organic acid in the composition.

It has been found that molybdenum can be added successfully to an "off-the-shelf" overbased alkaline earth metal sulfonate composition or phenate or salicylate detergent-dispersant composition. Moreover, it has been found surprisingly that the resulting overbased molybdenum-alkaline earth metal sulfonates, phenates or salicylates are gel-free, haze-free, precipitate-free, have reproducible TBNs, and provide friction-reducing, antiwear, anti-oxidation protection and rust prevention properties to lubricating oils to which they have been added.

The designation of an "off-the-shelf" overbased alkaline earth metal alkali metal sulfonate or phenate or salicylate means an already formulated and prepared overbased alkaline earth metal or alkali metal sulfonate or phenate or salicylate which is suitable for use in a lubricating oil composition but which lacks molybdenum to provide friction-reducing properties and anti-wear and anti-oxidation properties. The present invented process comprises a method for adding the necessary molybdenum to the already formulated overbased alkaline earth metal or alkali metal sulfonate or phenate or salicylate wherein the resulting product is haze-free, gel-free, precipitate-free, has reproducible TBN's and is commercially acceptable.

According to the method of the present invention, there is provided a process for incorporation of molybdenum into overbased alkaline earth metal and alkali metal sulfonates, phenates and salicylates, which process comprises: (a) introducing into a reaction zone a compound selected from the group consisting of a sulfonate, a phenate, and a salicylate wherein said compound is an overbased alkaline earth or alkali metal compound; (b) adding to said reaction zone a solvent to solubilize said compound and to form a mixture A; (c) heating said mixture A to an elevated temperature of 120° F. or less; (d) preparing an aqueous solution of a molybdenum compound at a temperature of 120° F. or less; (e) adding said aqueous solution of said molybdenum compound to said mixture A with stirring during a period of about 15 minutes or less to form a mixture B; (f) adding said mixture B containing said molybdenum compound to a non-polar compound at a temperature of 220° F. or greater within a period of up to 40 minutes wherein resulting mixture C during said addition is at a temperature of at least 220° F.; (g) driving off said water and said non-polar compound as overhead by increasing temperature of said mixture C containing said molybdenum compound to about 240° F. to about 300° F. to obtain a water-free composition; (h) adding additional quantity of non-polar compound to said water-free composition to dilute said composition to clarify said composition by filtration or centrifugation; (i) heating said clarified composition to a temperature of from about 300° F. to about 400° F. to remove solvent and said non-polar compound and to recover product comprising an overbased molybdenum-containing alkaline earth metal or alkali metal compound.

Molybdenum compounds useful in the present invention are those which provide oxides or sulfides of molybdenum under reaction conditions. Such molybdenum compounds are ammonium molybdate, molybdenum oxides and sulfides, and the Group I and Group II salts of molybdic acid, for example, sodium molybdate, potassium molybdate, magnesium molybdate, calcium molybdate, and barium molybdate. Molybdenum trioxide is preferable in a variety of the reaction sequences for the reasons of ease of solubility in basic aqueous solution (preferably ammonium hydroxide or sodium hydroxide), reactivity with the sulfonic acid and availability. In addition, the various isopoly and heteropoly organic acid molybdenum anions are also suitable for use in these processes. The isopolymolybdates, such as paramolybdates, are illustrative of anions derived from isopolyacids while heteropolymolybdates illustrate heteropolyacid anions. These various anions are derived from acidic materials well known in the art and an extensive discussion of the preparation and characteristics can be found in standard chemical texts, for example, F. A. Cotton and D. Wilkinson, Advanced Inorganic Chemistry, pages 134–141, 185–188, 260–265, 394–403, 423–437, 779–790, etc., published by Interscience Publishers, New York, N.Y., 1962.

In one embodiment of the invention, (a) a high base calcium sulfonate rust inhibitor is introduced into a reaction zone; (b) a solvent, methyl Cellosolve (Trademark), is added to the sulfonate and the mixture is heated with stirring to about 120° F.; (c) a solution of ammonium molybdate in a limited amount of hot water is added to the mixture of step (b) and mixed for a limited period of no more than 15 minutes; (d) the resulting mixture of step (c) is added with stirring to hot xylene previously heated to a temperature above 220° F., preferably between 228° F. and 237° F., said addition over a period of no more than 20 minutes; (e) the mixture of step (d) is heated to a temperature of about 250° F. to drive off the water-xylene mixture as overhead; (e) additional xylene is added to dilute the reaction zone product together with filter aid and the mixture is filtered; (f) the filtered product is heated to about 360° F. with a nitrogen purge and the remaining solvents are distilled off.

Alkaline earth metal compounds or Group IIA metal compounds into which molybdenum can be incorporated by the process of this invention are overbased compounds of magnesium, calcium and barium, such as magnesium sulfonate, calcium sulfonate, barium sulfonate, calcium Mannich phenate, sulfurized calcium phenate, and like barium compounds. The alkaline earth metal compounds can be either low-base or high-base, from a 10TBN to 500TBN.

Briefly, the process is carried out by incorporating a molybdenum compound into an overbased alkaline earth or alkali metal compound in the presence of a minimum amount of water and a suitable solvent needed to solubilize the molybdenum compound. Any compound which acts as a solvent for an alkaline earth or alkali metal overbased sulfonate or phenate or salicylate is suitable. A suitable compound which aids in the removal of water is then added to the solution at an elevated temperature. A compound which forms an azeotrope with water and has a boiling point greater than that of water is advantageous. The compound is added to the mixture at a temperature over the boiling point of water and the water is removed. The water is removed rapidly to minimize the contact of the water with the overbased material with consequent deterioration of the overbased material. The overbased material, with incorporated molybdenum, is gel-free, haze-free, precipitate-free, and is commercially acceptable.

It is essential, accordingly, that a solvent be used to solubilize the alkaline earth metal or alkali metal compound. It is essential that the temperature of aqueous molybdate solution be 120° F. or less. The alkaline earth or alkali metal sulfonate or phenate or salicylatein the presence of water or an aqueous solution of a molybdate degrades at an increased rate with an increased temperature. It is essential that contact time of the aqueous molybdate solution and overbased alkaline earth or alkali metal compound be minimal. It is essential that the compound be added to the reaction zone within a suitable time period to permit immediate distillation and removal of the water from the aqueous mixture. Temperature of the distillation is critical. If the temperature is too low, removal of the water is not fast enough and the product will be hazy and unsuitable for commercial use.

Solvents which are useful include methyl alcohol, ethyl alcohol, isopropyl alcohol, butyl alcohol, methyl Cellosolve (Trademark) and ethyl Cellosolve (Trademark). Methyl Cellosolve (Trademark) is preferred because it has excellent solubility in water and hydrocarbons at elevated temperatures. While the amount of solvent added is not critical, sufficient solvent should be added to the overbased alkaline earth metal sulfonate or phenate to solubilize the compound.

Suitable non-polar compounds useful in removing water from the reactor include xylene, toluene, octanes, nonanes and $C_{10}$–$C_{20}$ hydrocarbons which are inert to the overbased alkaline earth metal or alkali metal compounds. Xylene is preferred because it forms a water-xylene azeotrope and is easily available.

The following examples provide embodiments of the process of this invention. They are presented for the purpose of illustration only and are not intended to limit the scope of either the claims or the present invention.

EXAMPLE I

In a suitable reactor, 100 g of an overbased calcium sulfonate (TBN 300) rust inhibitor (analysis: 11.8 wt % Ca, 307 base number, 28.8 wt % sulfonate, 1.61 wt % sulfur, 115 cst viscosity at 210° F.) was mixed with 300 g of methyl Cellosolve (Trademark) at a temperature of 120° F. In a separate container, an aqueous solution of 6.5 g ammonium molybdate in 16 g water at 150° F. was prepared. The aqueous solution of 6.5 g ammonium molybdate was added to the reaction zone with stirring at a temperature of 120° F. and mixed for about 15 minutes. In a separate container, 450 g xylene was heated to 235° F. The hot mixture of overbased calcium sulfonate, methyl Cellosolve (Trademark), ammonium molybdate in water was added to the hot xylene. Temperature during addition was from 228° F. to 237° F. Time of addition was about 20 minutes. Heating was continued to increase pot temperature to about 250° F to distill any remaining water-xylene azeotrope as overhead. Enough xylene was added to bring the total volume of the product and solvent to 800 ml. The product was then filtered with use of filter aid. The remaining solvents were then removed from the product by heating the product mixture to 360° F. with a slow nitrogen purge. The product, 91.2 g, was a very bright, clear liquid. Analysis was 3.2 wt % molybdenum, 10.5 wt % calcium, TBN-275, Hach (in hexane) clarity of 38.

EXAMPLE II

The procedure of Example I was repeated. The aqueous solution of ammonium molybdate was added to the reaction zone containing the overbased calcium sulfonate but without the 300 g of methyl Cellosolve (Trademark) as taught in Example I. In the absence of methyl Cellosolve (Trademark), the product of the reaction analyzed: molybdenum12 ppm, calcium 11.8 wt %, TBN-295, Hach (in hexane) clarity-40.

The above results indicate that in the absence of a solvent, methyl Cellosolve (Trademark), the procedure of Example I does not incorporate molybdenum into an overbased calcium sulfonate in desirable amounts.

EXAMPLE III

The following example illustrates that the instant invented process results in a calcium sulfonate product which is clear, haze-free and precipitate-free.

In the procedure of Example I, and using a calcium sulfonate of the same analysis as in Example I, a suitable vessel was charged with:

100 g of Calcium Sulfonate (TBN 300)
300 g Methyl Cellosolve (Trademark)

The above was mixed well and heated to 120° F. At 120° F. a solution was added consisting of 6.5 g ammonium molybdate dissolved in 16.0 g of water. The addition took place over about a 10 minute period. After the addition, mixing at 120° F. was continued for another 10 minutes. This mixture was then added to 550 ml of xylene which had been heated to about 240° F. Heating was continued during the addition and the temperature was maintained between 228°-237° F. The addition took approximately 15 minutes. Water along with some methyl Cellosolve (Trademark) and xylene was flashed and removed overhead by these reaction conditions. Heating was continued to about 250° F. and then cooled to room temperature. The crude product was diluted to a total volume of 800 ml and filtered using filter cell as a filter aid. The solution filtered rapidly and easily. The xylene was then removed by heating to 360° F. and stripping with $N_2$. The clear liquid had the following properties: Mo wt %-3.2, Ca wt %-10.5, TBN-274.

EXAMPLE IV

The following example illustrates the presence of an alcohol as a solvent is essential to incorporate significant amounts of molybdenum into a sulfonate.

A suitable vessel was charged with:

100 g 400 TBN-Magnesium Sulfonate*
150 ml Xylene
100 ml Methanol

* Analysis: 9.3 wt % Mg, 409 base number, 27.1% sulfonate, 1.6 wt % sulfur, 64 cst viscosity at 210° F.

The above charge was mixed well and heated to reflux or approximately 149° F. At reflux, a solution consisting of 7 g of ammonium molybdate dissolved in 24 g of water was added to the refluxing mixture. The mixture was then heated rapidly to 240° F. to remove the methanol and some water. The mixture was then cooled and diluted to 400 ml total volume with fresh xylene. This solution was clarified by filtration with filter cell. The xylene was then removed by heating to 360° F. with a nitrogen stripping gas rate of 5 CFH. The bright and clear liquid contained 1.51 wt % Mo, 1.49 wt % S and 7.5 wt % Mg.

Three other identical preparations were made. The same procedures were used except methanol was not used in one and xylene not used in another. The results are as follows:

| Preparation | A | B | C |
|---|---|---|---|
| Methanol | None | None | 100 ml |
| Xylene | None | 150 ml | None |
| Mo wt % | 0.008 | 0.003 | 0.008 |
| S wt % | 1.46 | 1.46 | 1.46 |
| Mg wt % | 8.05 | 8.00 | 8.05 |

These results point out the importance and benefits of an alcohol as a solvent and a suitable non-polar compound to remove the water. The process will not incorporate significant amounts of molybdenum without an alcohol as a solvent and a suitable non-polar compound to remove the water present.

EXAMPLE V

The following example illustrates that a mid-process cannot be used for a high base calcium sulfonate since the calcium compound is very sensitive to amounts of water and degrades rapidly.

A suitable reactor was charged with 93.0 g Ammonium Sulfonate (containing 44.5 wt % sulfonate, 35% oil and 20.5% xylene with a molecular weight of 693)
74.0 g 5W Oil
385 ml Xylene The above materials were mixed well at room temperature and the following materials were added in the order listed:

58.9 g Calcium Oxide
36.6 g Methyl Alcohol
3.3 g Water

The charge was mixed well and $CO_2$ was added below the surface of the stirred mixture at 0.35 CFH. The temperature was allowed to rise to 120° F. and the 120° F. was reached after about 30 minutes of carbonation. Then the temperature was controlled by cooling the mixture, when needed, and 120° F. was maintained. A total carbonation time of about 115 minutes resulted in 100% absorption of the $CO_2$ added. A total of 37.0 g of $CO_2$ was consumed during the carbonation. The methanol and any residual water was removed by flashing off the crude product in hot xylene. This was done by heating 250 ml of xylene to about 240° F. and then adding the carbonated material so that the temperature of the hot phase was maintained at 230° F.-250° F. The methanol, water and some xylene were removed overhead. After all the carbonated crude product was added, the temperature was maintained at 230°-250° F. and 30 ml of water was added over about 10 minutes. The water flashed and was removed overhead along with some xylene. The sediment (unreacted CaO) was removed by centrifugation followed by filtration. The xylene was removed by heating to 360° F. with a $N_2$ strip.

The same procedure outlined above, D, was used in prepartion E, except that the mixture was refluxed and then cooled before carbonation. The product was very poor and is compared with the non-reflux case as follows:

| | D | E |
|---|---|---|
| Reflux | No | Yes |
| TBN | 388 | 376 |
| Viscosity cs @ 212° F. | 123 | 229 |
| Clarity | Bright and Clear | Very Hazy |

Other variations of a reflux case were tried and all were very poor. These are shown as follows:

| | F | G | H |
|---|---|---|---|
| Reflux | Yes | Yes | Yes |
| TBN | 343 | —* | 324 |
| Viscosity | 39 | Gel | TVTM |
| Clarity | Very Hazy | Very Hazy | Very Hazy |

*This preparation gelled during carbonation and could not be processed.

TVTM--Too viscous to measure.

EXAMPLE VI

The following example applies the post-moly process to a magnesium phenate. The magnesium phenate was prepared via the process of Hunt and Brannen (U.S. Pat. No. 4,435,301), had a base number of 243 and a magnesium content of about 5.4 wt %. Details were as follows:

A suitable vessel was charged with 100.0 g Magnesium Phenate 300.0 g Methyl Cellosolve (Trademark)

The above mixture was heated to 120° F. with mixing. A solution consisting of 6.5 g of ammonium molybdate, $(NH_4)_6Mo_7O_{24} \cdot 4H_2O$ in 16.0 water, was added over about a 5 minute period. Mixing was continued for about 30 minutes at 120° F. and then the water was flashed off overhead by adding the magnesium phenate mixture to hot xylene. This was carried out by heating 550 ml of xylene to approximately 240° F. and then adding the phenate mixture dropwise while maintaining the pot temperature at 229°-240° F. Distillate formed was removed overhead. The addition required about 40 minutes to complete. Then heating was continued to about 255° F. and some additional solvent or water was removed overhead. The crude mixture was then cooled, diluted to a total of 800 ml with fresh xylene and filtered using filter cell. The solvents were then removed by heating to 360° F. with a nitrogen strip of 5 CFH. This yielded 99.9 g of bright clear liquid product containing 2.16 wt % Mo, 4.3 wt % S and 5.6 wt % Mg.

EXAMPLES VII-IX

In the procedure of Example VI, Examples VII-IX were prepared.

Example VII used an overbased strontium sulfonate with a TBN of 82, a viscosity of 27.9 cs@212° F. and a strontium content of 7.8%.

Example VIII used a high base sodium sulfonate with a TBN of 405.6, a viscosity of 290 cs@212° F. and a sodium content of 17.3%.

Example IX used an overbased calcium salicylate obtained from Shell Chemical and identified as Shell AC-60C.

The post-moly process was used with the above products and the following summarizes the results:

| Example | VII | VIII | IX |
|---|---|---|---|
| Metal | Sr | Na | Ca |
| Product | Sulfonate | Sulfonate | Salicylate |
| % Mo | 0.31 | 1.07 | 0.73 |
| % Sr | 7.5 | — | — |
| % Ca | — | — | 5.4 |
| % Na | — | 16.0 | — |
| % S | 1.6 | 0.5 | 1.39 |

EXAMPLES X-XIII

In the procedure of Example VI, Examples X-XIII were prepared.

Example X used an overbased calcium sulfonate with a TBN of 370, a viscosity of 115 cs and a calcium content of 11.8%.

Example XI used an overbased calcium phenate with a TBN of 255, a viscosity of 186 cs and a calcium content of 9.2%.

Example XII used an overbased calcium phenate with a TBN of 132, a viscosity of 80 cs and a calcium content of 4.7.

Example XIII used an overbased calcium sulfonate with a TBN of 409, of viscosity of 71 cs and a calcium content of 15.4%.

The "post method" of the instant invention was used to incorporate molybdenum into the above already prepared compounds. The following summarizes the results:

| Example Number | % Mo | % Ca | TBN |
|---|---|---|---|
| X | 3.20 | 10.6 | 276 |
| XI | 1.40 | 8.8 | 213 |
| XII | 0.94 | 4.3 | 119 |
| XIII | 0.30 | 14.0 | 378 |

The products from Examples X-XIII were examined in the Hot Tube Test. In the Hot Tube Test, motor oils are tested for oxidative stability and are evaluated in terms of the amount of insoluble oxidation product deposits they form. The drain oils can be tested for the extent and pathway of oxidation of the parent oils, and for dispersancy.

The Hot Tube Test was developed to correlate with the Caterpillar engine 1H2 and 1G2 tests for oxidative stability and lacquer and top groove deposits. In the Hot Tube Test, evaluation of an oil's high temperature and oxidative stability is made by observing the hot tube deposits.

The oils are pumped from syringes at a controlled rate up through glass capillary tubes in a heating block; temperature is controlled by Eurotherm heat controller; carrier gas is fed into the glass tubes through calibrated flow meters. The standard test length is 16 hours (timer shuts system off automatically). The tubes are rated compared to a set of standard rating tubes for the amount of deposits present.

These products were examined in the Hot Tube Test. In all cases the products gave better oxidation control and a cleaner tube (a rating of 10 is perfect). This is shown in the following data table in which these additives were added to a formulated oil which has poor oxidation control:

| HOT TUBE TEST - COMMERCIAL TEST OIL | | |
|---|---|---|
| Example No. | % Molybdenum* | Hot Tube Rating |
| Baseline | None | 2.0 |
| X | 200 ppm | 5.0 |
| X | 100 ppm | 5.0 |
| XI | 200 ppm | 7.0 |
| XI | 100 ppm | 7.0 |
| XII | 200 ppm | 9.0 |
| XIII | 100 ppm | 8.0 |

*Enough product from Examples X-XIII were added to a commercial test oil to result in the molybdenum concentration shown. The lubricating oil contained conventional detergents and dispersants and had 0.9% magnesium, 0.5% calcium and 0.06% zinc.

EXAMPLE XIV

In the procedure of Example VI, Example XIV was prepared. However, larger amounts were used to prepare engine test quantities of the molybdenum containing additive. Example XIV used an overbased magnesium sulfonate with a TBN of 409, a viscosity of 64 cs about 212° F. and a magnesium content of 9.3%. The amounts used for this scaled up preparation were as follows:

550g Overbased Magnesium Sulfonate
1650g Methyl Cellosolve
35.8g Ammonium Molybdate
88.0g Water
2500ml Xylene Using the procedure of Example VI, the clear liquid product contained 1.96% molybdenum with a TBN of 375 and a viscosity of 144 cs at 212° F.

The product from Example XIV was tested in the single cylinder supercharged diesel test identified as the Caterpillar 1H2 test. This test uses a 133.5 CID supercharged diesel engine at 1800 rpm with 4950 BTU/minute 0.4%(wt.) sulfur fuel input, while oil temperature is maintained at 180° F. The test lasts 480 hours. The engine piston is rated for % top groove fill (% TGF), weighted lacquer demerits (WLD) and weighted carbon demerits (WCD). The sum of WLD and WCD is called weighted total demerits (WTD). The lower the % TGF and WTD, the lesser the amount of deposit.

Two 1H2 engine tests were carried out to compare the performance of the magnesium sulfonate, with and without molybdenum in a commercially formulated engine lubricating oil. The test is considered passing when the % TGF is less than 45 and the WTD is less than 140. After 480 hours, the results clearly show the significant superiority of the molybdenum containing formulations:

| Test | No. 1 | No. 2 |
|---|---|---|
| Molybdenum | none | 200 ppm |
| Engine Test Results | | |
| % TGF | 30 | 1 |
| WLD | 78 | 43 |
| WCD | 130 | 29 |
| WTD | 208 | 72 |

This product was also compared to conventional anti-oxidants in the sequence III D engine test. The III D test uses a 1977, 350 CID (5.7 liter) Oldsmobile V-8 engine at high speed (3,000 rpm) and a very high oil temperature of 300° F. for 64 hours. This test is used to evaluate the percent viscosity increase of the oil.

Two III D engine tests were conducted to compare the molybdenum containing magnesium sulfonate with a formulation containing untreated magnesium sulfonate and a conventional lubricating oil antioxidant. The viscosity of the lubricating oil is measured during the III D test and thereby an increase in viscosity due to oil oxidation can be observed.

It is well known in the literature that sulfurized hydrocarbons perform well as oxidation inhibitors in lubricating oils. (For example, see: U.S. Pat. No. 4,119,549). Using a conventional sulfurized hydrocarbon with "untreated" magnesium sulfonate, i.e. without molybdenum, a comparison was made with the "treated" magnesium sulfonate containing molybdenum. The results of this comparison were as follows:

| Engine Test | No. 3 | No. 4 |
|---|---|---|
| Magnesium type | untreated | treated |
| Example | — | XIV |
| % Sulfurized Hydrocarbon | 0.7 | none |
| Molybdenum | none | 200 ppm |
| Engine Test Results | | |
| % Viscosity Increase | | |
| 40 hours | 60 | 99 |
| 48 hours | 116 | 143 |
| 56 hours | 238 | 202 |
| 64 hours | 573 | 307 |

A test is considered passing when the viscosity increase is less than 375% after 64 hours. These tests demonstrate that the magnesium sulfonate containing molybdenum performs as well as or better than conventional sulfurized hydrocarbon antioxidants.

The product of Example XIV was also examined in the sequence II-D engine test. The II-D test uses a 1977, 350 CID (5.7 liter) Oldsmobile V-8 engine at moderate speed (1500 rpm) for 30 hours followed by a shut down for 30 minutes and two hours of high speed (3600 rpm) operation. The test measures the tendency of an oil to rust or corrode the valve train.

Magnesium sulfonates are well known to provide anti-rust protection to lubricating oils (for example, see: U.S. Pat. No. 3,150,089). Two II-D tests were run with and without molybdenum in the conventionally formulated lubricating oil. It was determined modification of the magnesium sulfonate with molybdenum does not interfere with the anti-rust properties. The results of the tests were as follows:

| Test | No. 5 | No. 6 |
|---|---|---|
| Magnesium Type | untreated | treated |
| Molybdenum | none | 200 ppm |
| Engine Test Results | 8.7 | 8.3 |
| Rust Rating | | |

The minimum allowable result for this test is a rust rating of 8.5 (a rating of 10 is perfect). The above test results show that the molybdenum treated magnesium sulfonate is as good or better than an untreated magnesium sulfonate.

What is claimed is:

1. A process for incorporation of molybdenum into overbased alkaline earth metal and alkali metal sulfonates, phenates and salicylates, which process comprises:

(a) introducing into a reaction zone a compound selected from the group consisting of a sulfonate, a phenate, and a salicylate wherein said compound is an overbased alkaline earth or alkali metal compound;

(b) adding to said reaction zone a solvent to solubilize said compound and to form a mixture A;

(c) Heating said mixture A to an elevated temperature of 120° F. or less;

(d) preparing an aqueous solution of a molybdenum compound at a temperature of 120° F. or less;

(e) adding said aqueous solution of said molybdenum compound to said mixture A with stirring during a period of about 15 minutes or less to form a mixture B;

(f) adding said mixture B containing said molybdenum compound to a non-polar compound at a temperature of 220° F. or greater within a period of up to 40 minutes wherein resulting mixture C during said addition is at a temperature of at least 220° F.;

(g) driving off said water and said non-polar compound as overhead by increasing temperature of said mixture C containing said molybdenum compound to about 240° F. to about 300° F. to obtain a water-free composition;

(h) adding additional quantity of non-polar compound to said water-free composition to dilute said composition to clarify said composition by filtration or centrifugation;

(i) heating said clarified composition to a temperature of from about 300° F. to about 400° F. to remove solvent and said non-polar compound and to recover product comprising an overbased molybdenum-containing alkaline earth metal or alkali metal compound.

2. The process of claim 1 wherein said sulfonate is selected from the group consisting of an overbased calcium sulfonate, an overbased barium sulfonate, an overbased sodium sulfonate and an overbased magnesium sulfonate.

3. The process of claim 1 wherein said phenate is a calcium Mannich phenate.

4. The process of claim 1 wherein said phenate is an overbased magnesium sulfurized alkyl phenate.

5. The process of claim 1 wherein said salicylate is an overbased calcium or magnesium salicylate.

6. The process of claim 1 wherein said molybdenum compound is selected from the group consisting of ammonium molybdate, molybdenum oxides and sulfides, and the Group I and Group II salts of molybdic acid.

7. The process of claim 1 wherein said molybdenum compound is selected from the group consisting of ammonium molybdate, sodium molybdate and molybdenum trioxide.

8. The process of claim 1 wherein said molybdenum compound is ammonium molybdate.

9. The process of claim 1 wherein said solvent is selected from the group consisting of methyl alcohol, ethyl alcohol, isopropyl alcohol, butyl alcohol, methyl Cellosolve (Trademark) and ethyl Cellosolve (Trademark).

10. The process of claim 1 wherein said solvent is methyl Cellosolve (Trademark).

11. The process of claim 1 wherein said solvent is methyl alcohol.

12. The process of claim 1 wherein said non-polar compound is selected from the group consisting of xylene, toluene, octanes, nonanes and $C_{10}$-$C_{20}$ hydrocarbons.

13. The process of claim 1 wherein said non-polar compound is xylene.

14. The process of claim 1 wherein said sulfonate is an overbased calcium sulfonate, said solvent is methyl Cellosolve (Trademark), said non-polar compound is xylene, and said product is an overbased molybdenum calcium sulfonate.

15. The process of claim 1 wherein said sulfonate is an overbased magnesium sulfonate, said solvent is methyl alcohol, said non-polar compound is xylene and said product is an overbased molybdenum magnesium sulfonate.

* * * * *